US006359203B1

(12) United States Patent
Cronos

(10) Patent No.: US 6,359,203 B1
(45) Date of Patent: Mar. 19, 2002

(54) METHOD AND STRAP SUPPORT ASSEMBLY FOR HOLDING MUSICAL INSTRUMENT IN UPRIGHT POSITION

(76) Inventor: Arthur Cronos, P.O. Box 969, Fairfax, CA (US) 94978

( * ) Notice: Subject to any disclaimer, the term of this patent is extended or adjusted under 35 U.S.C. 154(b) by 0 days.

(21) Appl. No.: 09/717,502

(22) Filed: Nov. 20, 2000

(51) Int. Cl.[7] ..... G10D 3/00

(52) U.S. Cl. ..... 84/327; 84/280; 84/281

(58) Field of Search ..... 84/327, 421, 280, 84/281

(56) References Cited

U.S. PATENT DOCUMENTS 2,643,039 A * 6/1953 Sottile ..... 224/614
5,596,158 A * 1/1997 Tonon ..... 84/327
6,040,509 A * 3/2000 Fanella ..... 84/280

* cited by examiner

*Primary Examiner*—Shih-Yung Hsieh

(57) ABSTRACT

A support which positions a musical instrument or other device in front of a musician or user in a near-vertical orientation, while comfortably distributing the instrument's weight upon the musician's body. It comprises a strap made from a strip of flexible material which is passed over the shoulder of a musician. The ends are attached to a guitar at points of attachment located upon either side of the guitar's body, a departure from previous practice. Due to the selection of the points of attachment, the guitar is supported in a generally vertical orientation. The tuner head or upper portion of the guitar then extends to a position generally above the musician's shoulder. A shoulder pad of cushioning material is slidably affixed to the underside of the strap. An adjustable cord or strap is attached from the shoulder pad to the guitar's tuner head, whereby the cord can secure and stabilize the positioning of the tuner head and thus the vertical orientation of the guitar. In addition, upwardly-pulling tension afforded by the cord's attachment to the guitar's tuner head stabilizes the position of the shoulder strap at the highest point of the strap, which is above the musician's shoulder. The guitar is supported and positioned in a near-vertical position, and the musician can play freely with both hands, without requiring either hand for support or positioning of the instrument. Such positioning enhances certain musical techniques, including 'two-handed tapping' or 'touch-style' methods of play. The guitar will remain in the proper playing position during seated or standing performance and during performance gyrations, and the shoulder pad will remain properly positioned atop the musician's shoulder during a performance.

5 Claims, 4 Drawing Sheets

METHOD AND STRAP SUPPORT ASSEMBLY FOR HOLDING MUSICAL INSTRUMENT IN UPRIGHT POSITION

BACKGROUND—Field of the Invention

This invention relates generally to devices worn by a person for supporting an object in front of his or her body, and specifically to strap arrangements for supporting a musical instrument such as a guitar or other tool or device.

BACKGROUND—Prior Art

Many players of amplified electric stringed instruments such as an electric guitar or an electric bass prefer to position the instrument in a vertical or near-vertical position. 'Near-vertical position' for a right-handed player would position the instrument's tuning head above a musician's left shoulder and to the left of the musician's head.

The near-vertical position facilitates certain types of play. In particular, the near-vertical position permits the left hand to press strings to frets with minimal bending of the left wrist, which alleviates the weakness, fatigue, and potential medical problem of playing with a sharply-bent wrist.

Further, there is a method of playing stringed instruments called 'two-handed tapping' or 'touch-style' in which the player taps the fingers of both bands upon strings simultaneously, permitting piano-like music such as simultaneous melody and chords, melody and counter-melody, bassline and chords, etc. In touch-style play, both hands must be free to move lightly above the fretboard, thus requiring the instrument to be supported in such a way that no assistance from the hands is required for positioning.

In touch-style play, the near-vertical position affords the player an advantageous positioning of both hands, permitting easy access to all fretboard notes without undue hand strain; and any volume or tone controls mounted on the front face of the instrument's body are easily accessible with either hand.

Although the near-vertical positioning of an instrument affords these benefits, it is difficult for a musician to maintain a stable near-vertical position with most existing support systems such as straps, belts, and belt-hooks.

In addition, many modern electric guitars and especially electric basses are quite heavy, so that supporting an instrument during extended periods of play is fatiguing to a musician, which in turn impairs the musician's ability to play well. Consequently, a support system for a musical instrument should optimally distribute the instrument's weight comfortably upon the musician's body.

In addition, a musician may prefer to play either while sitting or standing (possibly with performance gyrations), and the musician may be required to alternately stand and sit in a single performance. However, many existing support systems function poorly in one or the other of the two playing positions.

Similar considerations may on occasion apply to other musical instruments, such as a saxophone or synthesizer controller or an electronic drum device such as those marketed under the trademarks "ZENDRUM" or "SYNTHAXE"; or to any type of tool supported in front of a user's body, especially when usage of such tool would be facilitated by a stable, near-vertical position, or when such tool requires two-handed operation by the user.

The apparently-contradictory demands for stability and freedom of expression, for simplicity and significant weight distribution, and for seated-position and standing-position play have led to the development of many musical-instrument support systems, such as straps and belts and belt-hooks. However, in this crowded field, the solutions previously developed fail to address all the issues, or in some cases create other performance difficulties such as requiring substantial time to don or remove, or such as interfering with the performer's costume.

The most popular support for electric guitar or bass has been the common 'guitar strap,' which is attached to the lower end ("the base") of a guitar, from which point it passes behind the musician's back and forward over his or her left shoulder, and is attached to either the tuner head of the instrument, or more commonly to the instrument's body near the neck, as illustrated in FIG. 1.

This type of support is simple, inexpensive to manufacture, familiar to musicians, quick to don or to remove, produces no discomfort to a female musician's breasts, and does not interfere with a musician's costume. Perhaps for these reasons, the common guitar strap has been the mainstay of guitar support systems for hundreds of years.

The selection of attachment points upon which the guitar strap is affixed to the body of the guitar as illustrated in FIG. 1 tends to make the guitar rest in a stable fashion in a near-horizontal position that is convenient for traditional methods of play. As shown, the musician presses the instrument's strings to the instrument's neck using his or her left hand while using his or her right hand to pluck the strings.

However, for alternative methods of play that are facilitated by positioning the instrument in a near-vertical position, the common guitar strap does not fare so well. The common guitar strap will not hold an instrument in a stable near-vertical position, because as soon as the left hand is removed from the neck, the weight of the tuner head causes it to sink to a lower level where it finds equilibrium. This problem is exacerbated when playing high-pitched notes near the instrument's body, because the left hand can offer minimal support, or when playing touch-style or two-handed tapping, again because the hands can offer minimal support.

There also exist a number of 'shoulder-pad' designs that provide a wide pad of comfortable material through which the common guitar-strap is threaded such that the shoulder-pad rides upon the musician's shoulder and below the strap. This arrangement spreads the pressure of the guitar strap over a larger area of the musician's shoulder, increasing comfort somewhat. Although the shoulder-pad often affords adequate weight distribution, it may not be enough distribution to make the heaviest instruments comfortable. Also, shoulder-pads are frequently known to slide forward or backward off the musician's shoulder during a performance, and once so ill-positioned, they afford no benefit.

In U.S. Pat. No. 5,483,860 to Adams (1996), an additional strap segment is connected to the rear of a basic guitar strap, from which point it passes around the musician's left side to connect to the instrument. This triangulated attachment stabilizes the instrument, preventing side-to-side movement, but if the tuning head is raised high it will not remain there, and the full weight of the instrument is still borne on one of the musician's shoulders, which is uncomfortable for any length of time.

In U.S. Pat. No. 4,254,901 to McIntosh (1981), an additional strap segment is connected to the rear of the basic guitar strap, from which point it passes over the musician's other shoulder to attach to the instrument. This distributes the weight equally on both shoulders and is much more comfortable. However, if the tuning head is raised high to a near-vertical position, gravity and the tension of the strap itself will prevent its remaining in the near-vertical position.

In U.S. Pat. No. 4,279,367 to Jacobs (1981), an extension or additional strap is used in combination with a basic guitar strap. This second strap is attached to the instrument's body near the neck and then passes across the musician's chest and wraps around his left side and around his body to attach at the base of the instrument. While this greatly stabilizes the instrument and tends to prevent the tuning head from dipping lower, the tension of the lower strap will prevent the instrument from being supported in a stable near-vertical position. Further, although the strap offers some weight redistribution to the musician's torso, most of the instrument's weight still rests on one of the musician's shoulders, which can be uncomfortable. Further, this device may require substantial time to don or remove, and if the musician is female, it may be uncomfortable to the breasts.

In U.S. Pat. No. 4,930,695 to Thompson and Peters (1990), a strap assembly in the shape of a figure-eight is put on much like a jacket, so that a strap goes over each shoulder and a strap goes around each side of a musician's body to attach to an instrument. This provides good weight distribution, and the instrument is positioned in stable fashion in front of a musician's body. However, if the tuning head is positioned in near-vertical position, the dual tensions of the strap assembly will quickly lower the head again.

In U.S. Pat. No. 4,802,613 to Tierney (1989) and in U.S. Pat. No. 5,215,239 to Walters (1993), harness variations attach to an instrument at a single point. Although this is appropriate for an instrument which balances nicely such as a saxophone, it does not work for an electric guitar or especially electric bass, both because the tuner head has top-heavy weight which tends to fall to one side or the other, and because on the body of the instrument it is difficult to find a single balance point which does not permit the instrument to flop around unpredictably.

In U.S. Pat. No. 5,332,137 to Violette (1994), a belt is worn around a musician's waist, and from the rear center of this belt a strap segment passes over the musician's shoulder to attach to the instrument. Two short straps depend from the belt; and these are affixed to the rear surface of the instrument's body. This triangulated support will hold the instrument without swaying. Although this arrangement could be modified to provide near-vertical positioning, there would then be nothing to prevent the top-heavy tuning head from falling to the musician's right, carrying the support strap off the musician's shoulder. Further, although this arrangement provides some weight redistribution to the musician's hips, the device is more expensive to manufacture, may interfere with the performer's costume, is time-consuming to don or remove, and will not permit seated play.

Mark Warr of Warr Guitars (Long Beach, Calif.) developed a strap (circa 1994) that affixes to the guitar's body using two attachment points in such a way that the guitar can be temporarily supported in a near-vertical position. However the orientation of the instrument is not stabilized, which permits the tuner head of the instrument to fall forward, away from the musician's body, or to move back toward the musician's head, and even in some cases to strike the musician on the head if the musician is less than alert. Therefore, some control must be provided by the musician's hands. Further, given any downward pressure applied to the neck by the musician's playing hands or by performance gyrations, the neck can easily reposition itself in normal horizontal position.

In U.S. Pat. No. 3,371,570 to Lester (1968), a flat hook ("belt-hook") is attached to the rear of an instrument's body, permitting the musician to quickly place the hook over the top of the musician's pants so that the musician's trousers belt will support the weight of the instrument. This easily provides near-vertical positioning, although a heavy instrument could weigh uncomfortably on the musician's belt, or in the case of unbelted trousers with an elastic waistband, the instrument could unpredictably disrobe the musician. In addition, the instrument has no vertical stability. If the musician's hands are removed from the instrument, it will fall. Further, because the base of the instrument is pressed by the hook very close to the musician's lower torso, the instrument interferes with the seat of a chair if the musician attempts to sit down to play. Notwithstanding differences in construction, the same virtue and objections apply to U.S. Pat. No. 5,000,071 to Thomas (1991).

In U.S. Pat. No. 3,833,751 to Chapman (1973), a type of electric guitar is shown which uses a belt-hook similar to that of Lester as the primary weight-bearing support. A small, non-weight-bearing strap that passes around the musician's torso and attaches near the instrument's tuner head provides vertical stability. This is a stable support system that provides near-vertical positioning, but again the weight borne on the musician's trousers belt can be uncomfortable or can pull the trousers down. In addition, the instrument must be donned or removed in two steps—first the belt-hook is positioned, and then the strap is put on and positioned. Further, this upper strap can interfere with the performer's costume, and also may not be comfortable to female musicians. Finally, the belt-hook assembly positions the base of the instrument in such a way that it can interfere with most types of seating if the musician is attempting to play while seated.

In U.S. Pat. No. 5,069,103 to Healy (1991), a belt-hook assembly is attached to the rear surface of the body of an instrument, and the musician wears a belt assembly to which is fastened a depending strap segment which attaches to the base of the instrument's body. Although the instrument can be quickly donned or removed, the assembly does not permit near-vertical positioning, the belt assembly can weigh uncomfortably on the musician's body, and the device will not support an instrument during seated play.

Musician Bob Culbertson of San Jose, Calif. developed (circa 1992) a simple apparatus for musical instrument support, which he has used during public musical performances for many years in the San Jose area and during student teaching sessions at Guitar Showcase music store of San Jose. The apparatus comprises a bar attached across the rear lower surface of a guitar-like instrument, in such a way that this bar in a horizontal orientation protrudes to either side of the instrument. To play while seated, the protruding ends of this crossbar rest upon the player's thighs, thus supporting the entire weight of the instrument. As long as the player also uses his or her hands upon the upper fretboard of the instrument it will remain positioned in an upright and stable orientation, but of course the apparatus is of no assistance during standing play.

There are in addition a number of specialized instrument support systems for seated play, including U.S. Pat. No. 5,616,874 to Kraus and Kraus (1997) and others. However, none of these provide near-vertical positioning, nor stability when the bands are removed from the instrument, nor support during standing performance.

OBJECTS AND ADVANTAGES

Accordingly, one object of this invention is to provide an improved support for guitar or other implement. Additional objects are to provide a strap assembly which is cheap to manufacture, familiar to musicians, quick to don or remove, and does not interfere with a performer's costume.

The present invention affords near-vertical positioning of an instrument, and is stable in all planes without any requirement that a musician use his hands to assist the support or stabilization of the instrument. It provides weight distribution by means of a shoulder pad that is dynamically self-positioned and will not slide off the musician's shoulder. An optional second strap over the other shoulder can afford further weight distribution if desired, as can adding an optional belt support device or belt-hook support device.

The present invention provides these benefits either during standing or seated play, with no adjustment required when changing from standing to seated or vice versa.

Additional objects and advantages will become apparent from a consideration of the drawings and the ensuing description.

REFERENCE NUMERALS AND NOMENCLATURE IN DRAWINGS

10 Musician
12 Guitar
14 Tuner head
16 Neck
18 Body
20 Present Invention (Strap Assembly)
30 Prior-Art Support Strap
32 Prior-Art Top Strap Attachment Point
34 Prior-Art Bottom Strap Attachment Point
40 Strap
42A, 42B End-Piece
44A, 44B Buttonhole
46A, 46B Button (mounted on guitar)
50 Buckle
52 Shoulder-Pad
54 Slot
60 Cord
62 Attachment Point
64 Adjustment Tongue
66 Adjustment Fastener

SUMMARY

The present invention is a guitar strap which supports and positions a musical instrument or other device in front of a musician or user in a near-vertical orientation, while comfortably distributing the instrument's weight upon the musician's body. It comprises a strip of flexible material, the ends of which are attached to the instrument. When the strip is attached to a guitar, the weight of the guitar is transferred to the shoulder of the musician. Affixed to the underside of the strip (guitar strap) is a pad (shoulder pad) to cushion this weight upon the musician's shoulder. In use, the shoulder pad is located at the highest point upon the strap, which point is naturally located immediately above the musician's shoulder. The ends of the guitar strap are attached to a guitar on either side of the instrument's body. Due to this novel location of the points of attachment, the guitar is supported in a generally vertical orientation. Its tuner head extends to a position generally above the musician's shoulder. An adjustable cord or strap is attached from the guitar's tuner head on its upper end to the shoulder pad. The primary purpose of this cord or strap is to stabilize the positioning of the tuner head and thus the vertical orientation of the guitar. Its secondary purpose is to stabilize the position of the shoulder pad at the highest point of the strap, above the musician's shoulder.

In more general terms to allow for alternative embodiments, the present strap assembly describes a strap or harness worn upon the body of a musician or operator. This strap contains a lower portion in the vicinity of the musician's waist and upon this lower portion can be affixed means of attachment to the lower portion of a musical instrument or other implement. Upon the strap there is an upper portion in the vicinity of the musician's chest or shoulder and upon this upper portion can be affixed a means of attachment to the upper portion of a musical instrument whose body is of sufficient length to extend upwardly to the region of the musician's shoulder or above the musician's shoulder.

Figure 1:
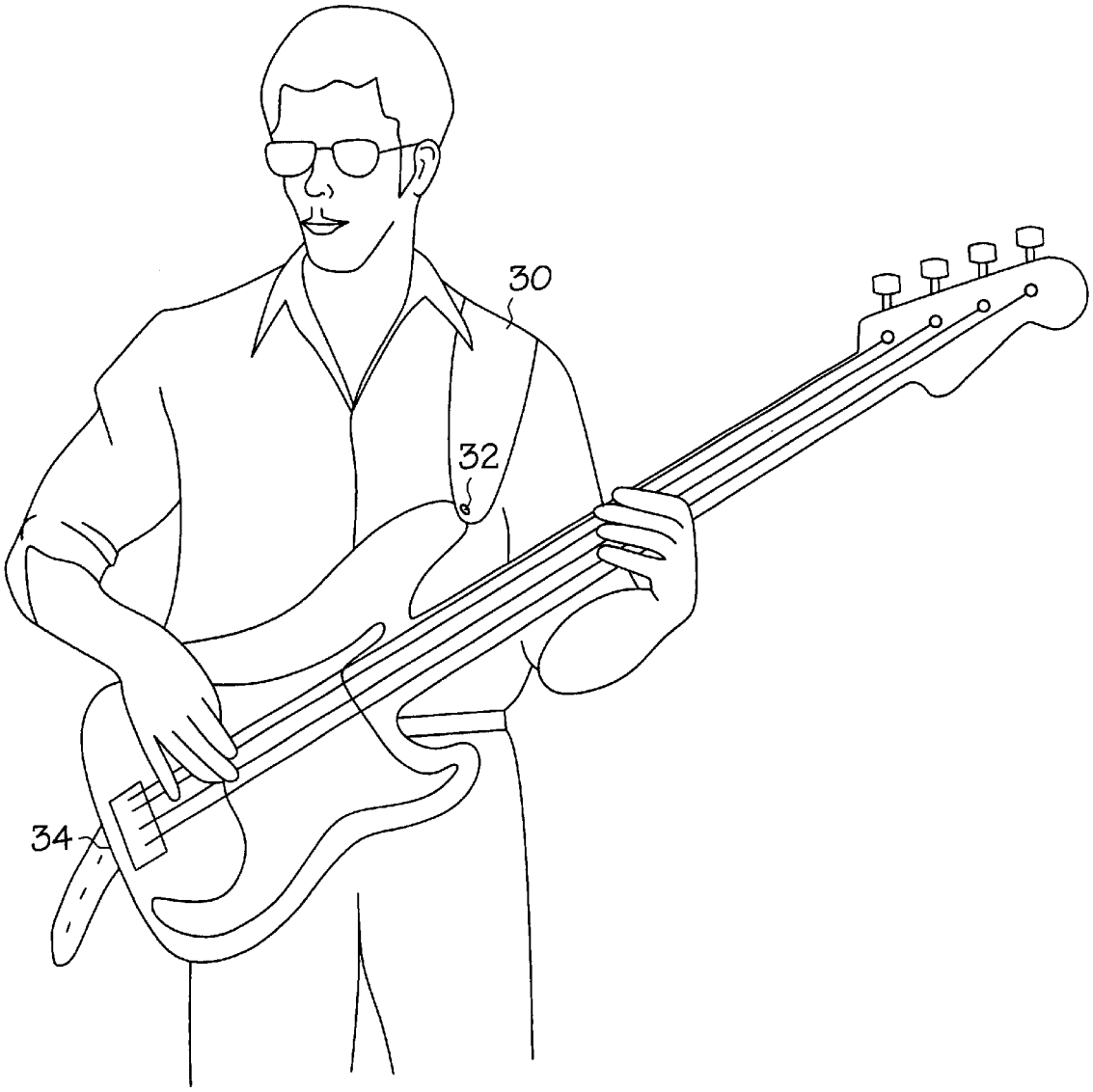
FIG. 1 PRIOR ART
FIG. 1 is a front view showing a prior-art guitar strap and a musical instrument supported in a generally horizontal orientation upon a musician's body by the strap.
Figure 2:
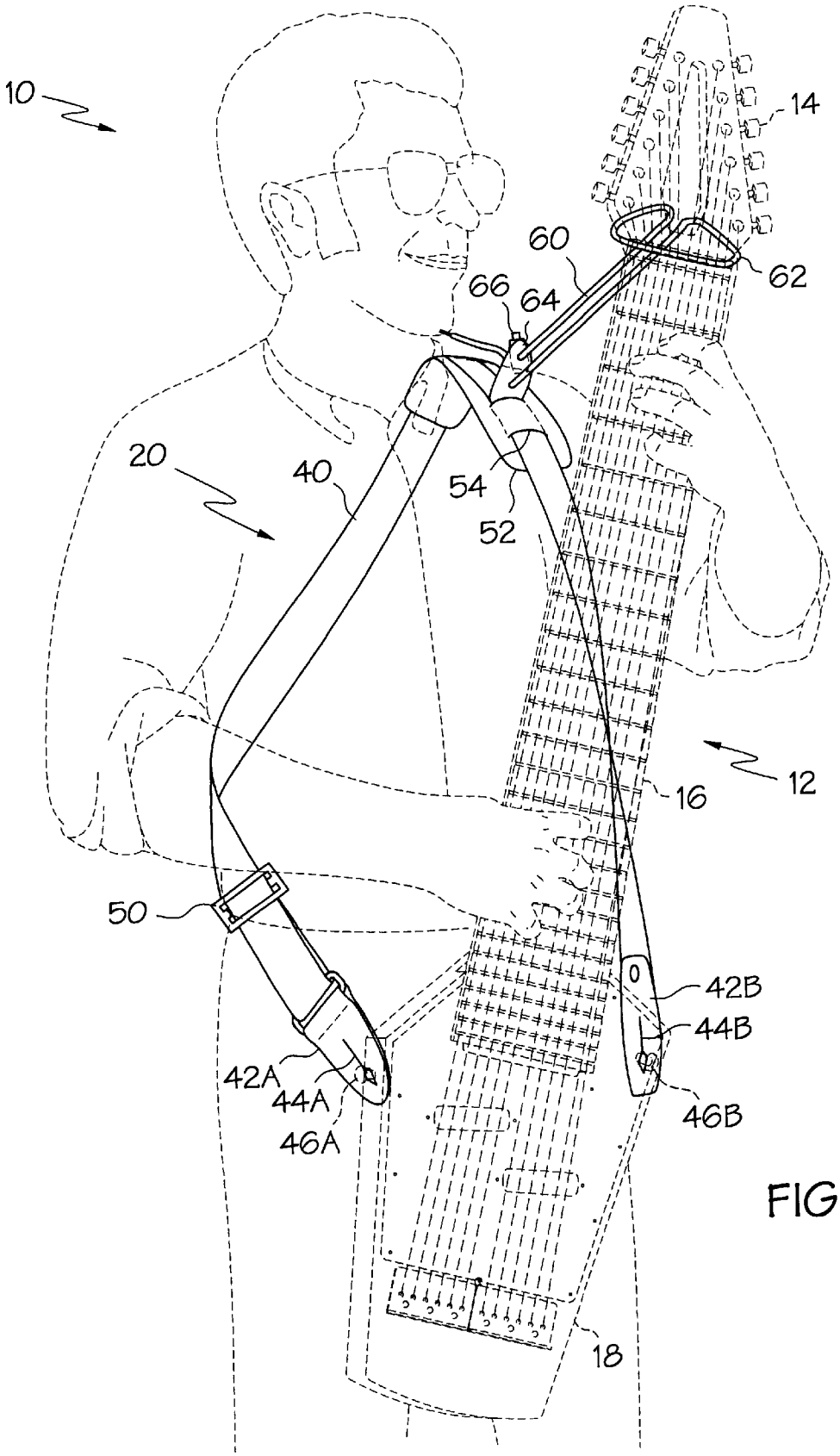
FIG. 2 is a front view of a guitar strap according to the present invention, shown supporting a musical instrument in a vertical or near-vertical orientation.

FIG. 2—Detailed Description of Preferred Embodiment

Is a front view of a musician 10 playing a guitar 12 in near-vertical position. The guitar comprises a tuner head 14, a neck 16, and a body 18. As shown, guitar 12 is supported in a substantially upright or near-vertical position by a strap assembly 20.

Strap assembly 20 comprises a strap 40 of flexible material such as leather or fabric. The ends of the strap have end pieces 42A and 42B.

The end pieces have means of attachment to the guitar, namely slotted buttonholes 44A and 44B to accommodate buttons 46A and 46B.

Each of buttons 46A and 46B consists of a button-shaped stud with a head larger than its shaft. One of the buttons is affixed to either side of the guitar's body 18 as shown.

A strap 40 passes over the shoulder of the musician and extends downwardly toward the guitar's buttons, to which the strap's end pieces are affixed during performance.

That segment of the strap that is affixed to end piece 42B descends from the musician's shoulder in front of the musician's chest so that end piece 42B may be attached to button 46B. That segment of the strap that is affixed to end piece 42A descends rearwardly from the musician's shoulder to pass behind the musician's back and around the musician's side so that end piece 42A may be attached to button 46A.

Strap 40 has a buckle 50 that permits adjusting the length of the strap.

Strap 40 is equipped with a shoulder pad 52, which is a pad of cushioning material slidably affixed to the under surface of the strap. As shown, the shoulder pad has slots 54 through which the strap may be threaded, providing a simple means of slidably affixing the shoulder pad to the strap.

Cord 60 is a length of cording, or a smaller strap, or any suitable flexible material with means of attachment to an attachment point 62 located on the guitar's tuner head 14.

Cord 60 is adjustably secured to an adjustment tongue 64. As shown, the cord is secured to the adjustment tongue by means of an adjustment fastener 66. The adjustment fastener permits the length of cord 60 to be extended or reduced as required for positioning of tuner head 14.

Adjustment tongue 64 is affixed to shoulder pad 52.

Figure 3:
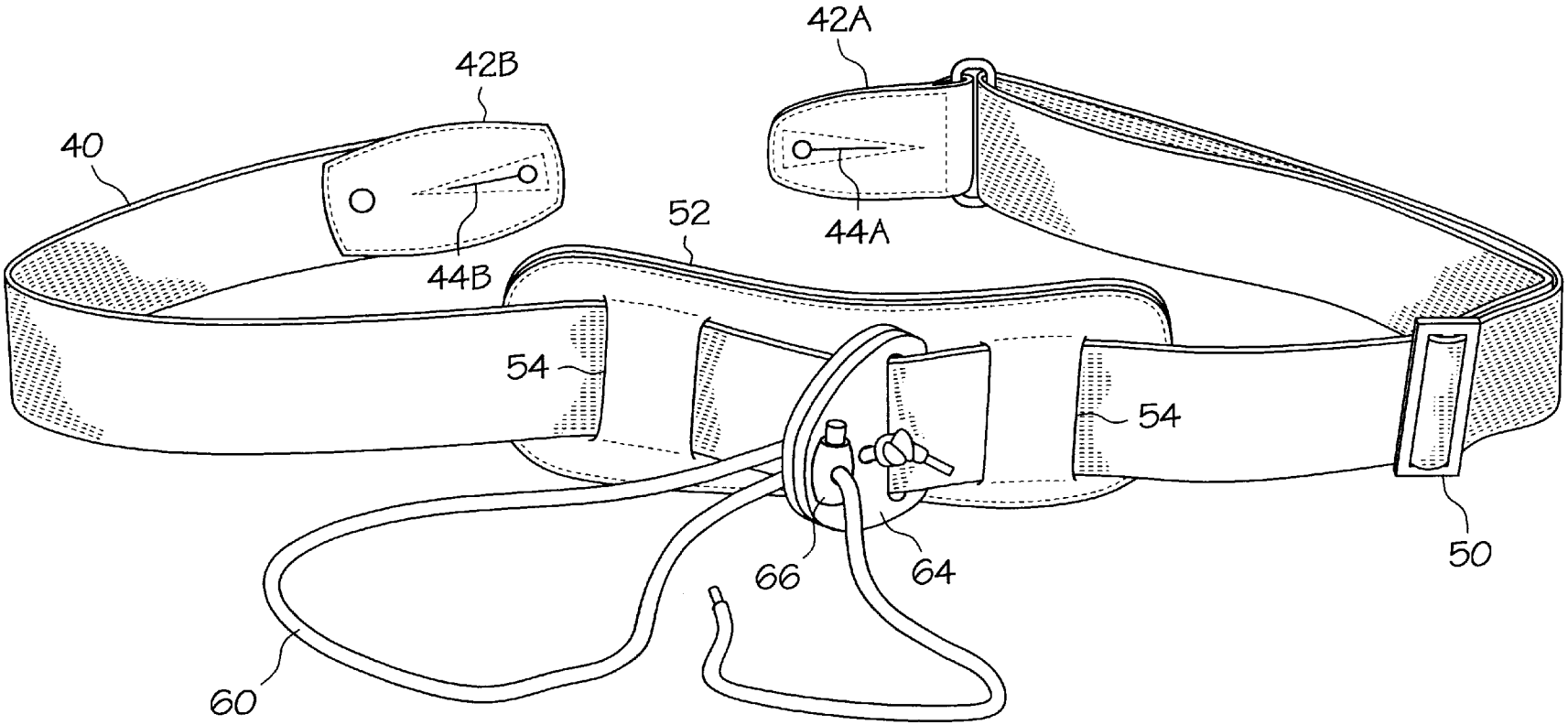
FIG. 3 is a detailed view of the components of the strap.

FIG. 3—Detailed View

Is a detailed view of the components of the present strap.

Strap 40 is made of a flexible material of sufficient strength to support a musical instrument such as an electric guitar or electric bass. End pieces 42A and 42B are affixed to the ends of the strap, and possess slotted buttonholes 44A and 44B.

Buckle 50 possesses means of lengthening strap 40, permitting the musician to adjust the positioned height of the musical instrument supported by the strap.

Shoulder pad 52 is affixed to the strap by means of slots 54, and adjustment tongue 64 is affixed to the shoulder pad. Adjustment tongue 64 comprises a flexible material and possesses means of adjustably securing cord 60. As shown, the length of cord 60 may be adjusted by means of adjustment fastener 66.

Figure 4:
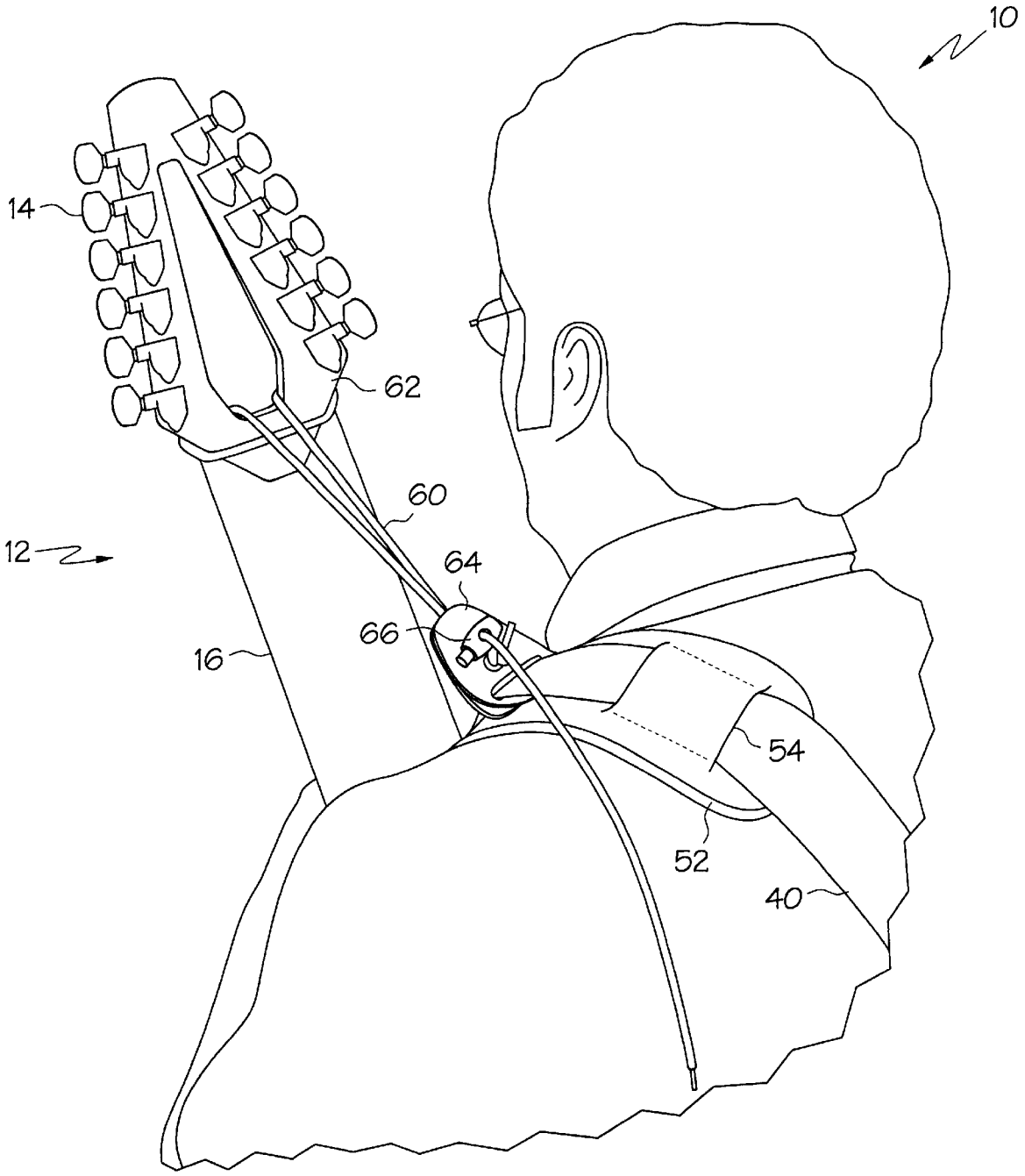
FIG. 4 is a rear detail view showing the present strap's adjustable means of attachment to the upper portion of the musical instrument.

FIG. 4—Rear Detailed View

Is a rear detail view showing musician 10 playing guitar 12. Shoulder pad 52 rests upon the musician's shoulder. Pad 52 is affixed to strap 40 by means of slots 54.

The guitar's neck 16 is maintained in a near-vertical playing position by means of tension afforded by cord 60, which extends between and maintains a fixed distance between the guitar's tuner head 14 and shoulder pad 52.

Cord 60 is secured to the shoulder pad by means of adjustment tongue 64 and adjustment fastener 66.

The length of cord 60, and thus the positioning in space of the tuner head 14, is effected by adjustment means provided by adjustment fastener 66.

Simultaneously, the correct positioning of shoulder pad 52 upon the top surface of the musician's shoulder is properly maintained by the tension afforded by cord 60, which extends between and maintains a fixed distance between tuner head 14 and shoulder pad 52.

Operation

A musician employs the following steps to use the present strap assembly:

(a) The musician first attaches strap assembly 20 to guitar 12.

(b) The musician next places strap assembly 20 upon his or her body, thus supporting the guitar.

(c) The musician next adjusts the length of strap 40 so as to position the playing height of the guitar so that the musician's hands can fall comfortably upon the playing surface.

(d) The musician last adjusts upper cord 60 to stabilize the position of the guitar's tuner head 14.

Now that the guitar is supported and positioned in near-vertical position, the musician can play the guitar with both hands, without the need to use either hand for support or for positioning of instrument. The guitar will remain in proper playing position during seated or standing performance, and with minimal motion relative to the musician's body during performance. The musician can easily reach all the notes available on the guitar's neck, and the need for any awkward twisting or turning of the musician's hands to reach certain notes is eliminated. Further, the weight of the instrument as it bears upon the musician's shoulder is minimized, and shoulder pad 52 is prevented from sliding off the musician's shoulder during the performance.

CONCLUSIONS, RAMIFICATIONS, AND SCOPE

Accordingly, it can be seen that the above-described strap assembly enables a musician or other user of tools or devices to utilize a harness-like structure to correctly and conveniently position a musical instrument or other tool or device in a vertical or near-vertical orientation in front of the user's body. Furthermore the user's hands will be freed of any requirement for support or orientation of the instrument, so that consequently the user may use both hands freely for the operation of the instrument. Also, the weight of the instrument upon the body of the user may be made more comfortable by a shoulder-pad and optionally by a variety of other devices, such as an additional strap, a belt-hook, a supporting belt, or during seated operation a crossbar supported upon the thighs.

Although the description herein contains many specific details, these should not be construed as limiting the scope of the strap assembly but as merely providing illustrations of some of the presently preferred embodiments. Various other embodiments and ramifications are possible within its scope.

While the above description is confined to supporting a guitar, the present strap assembly is also suitable for supporting other musical instruments as well as other tools or implements whose use would be enhanced by support in an upright or near-vertical position.

Also, devices as various as woodshop implements, powered leaf-blowers and other devices used for trimming in yard care, control panels for any remotely controlled device, such as a model plane or a robot or a device to explore the surface of a distant planet or the bottom of the sea, small acoustic bass instruments, computer operating keyboards and graphic input devices and motion sensing devices, musical input devices, including keyboards, drum triggers, and guitar-like devices containing either strings or buttons for operation, display devices and music-mixing or sound-mixing devices or camera control panels, and many more tools and devices can be made portable, comfortable, and accessible by the user's two hands by means of this method of support.

Any type of control panel or device may be vertically suspended with comfort and stability, so that the user's arms are not obstructed in reaching any section of such a control panel and the user's hands can then operate the device as easily as the user might tap upon the user's chest.

The means of attachment and length adjustment described in the preferred embodiment merely represent simple and widely used means commonly seen in the crowded field of guitar straps and in commercially available guitar straps. However, many alternative means are feasible, and the present invention also covers the substitution of these alternate means for attachment and length adjustment.

For example, the means of attachment of the strap to the guitar's body can be provided by various commercially-available connecting devices, including those marketed under the trademark STRAP LOCKS by the Schaller company.

Similarly, the means of attachment of the cord to the tuner head can be attained by use of alternative means, including knots, glue, screws, hooks, buttons, or releasable connectors commonly used in the construction of luggage and backpacks.

The shoulder pad can be attached to the strap by alternative means, including the use of hook-and-eye fastening material, or the shoulder pad can be made an integral portion of the strap.

Similarly, the means of length adjustment for the strap, or for the cord, can be attained by alternative means including the use of hook-and-eye fastening material, or by the use of a buckle equipped with a metal tongue of the type commonly used in belts on men's trousers, or by the use of plastic connectors commercially available.

If additional weight distribution is desired, in order to further reduce the weight borne by the musician's shoulder, several modifications of strap design can be employed, including a construction utilizing two straps engaged in a fashion similar to men's suspenders, so that only half the guitar's weight is borne on each shoulder.

Similarly, additional weight-support devices may be used in combination with the present strap assembly to accomplish additional weight distribution. Such additional weight-support devices can include devices such as a belt-hook or a weight-supporting belt or during seated play a crossbar that rests upon performer's thighs, etc. The present invention includes these extensions if additional weight distribution is desired.

Certain guitars do not have bodies, and some guitars position the tuner devices in various locations, and some tools or devices other than musical instruments have no designated body nor tuner head. Therefore attachment to the 'body' or to the 'tuner head' of such an instrument would be impossible, and in that case attachment would be made to the 'lower portion' or to the 'upper part' of the instrument as required.

Accordingly, the scope of the invention should be determined by the claims and legal equivalents, and not by the examples given.

I claim:

1. A method for supporting and positioning a musical instrument or other tool or implement having a body with a lower section in a substantially upright or near-vertical position, so that an upper portion of said musical instrument is positioned generally above a musician's shoulder, comprising:

(a) providing a strap which fits upon the body of said musician, said strap having a pair of opposite ends, each end of said strap including means for attachment to the said lower section of said musical instrument, (b) providing, upon an upper portion of said strap, means for attachment to an upper section of said musical instrument in the region generally at or above said musician's shoulder, whereby said musical instrument can be supported and positioned in a near-vertical position, and whereby said musician or operator can use both hands freely to play upon or operate said musical instrument or other implement.

2. The method for supporting and positioning a musical instrument of claim 1, further including providing a means for length adjustment of said strap, whereby by shortening or lengthening said strap, said attached musical instrument is raised or lowered, and whereby the hands of said musician or operator are enabled to rest upon the playing or operating surface of said musical instrument in the most comfortable position or to maximize access to a particular portion of said musical instrument, and whereby said musician may use his or her hands with minimal bending of the wrists so as to minimize fatigue during performance and to minimize various medical problems which may attend the repeated use of the hands with wrists bent.

3. A strap assembly for supporting and positioning a musical instrument or other tool or implement upon the body of a musician or operator, comprising:

(a) a strap which can pass over said musician's shoulder, (b) each end of said strap having means for attachment to a lower part of a musical instrument, (c) said strap having an affixed cord in the general region where it passes over said musician's shoulder, (d) said cord having means of attaching said cord to an upper part of said musical instrument, whereby said musical instrument can be supported upon the body of said musician and positioned in an upright, near-vertical position, and whereby said musician or operator can use both hands freely to play upon or operate said musical instrument or other implement.

4. The strap-assembly of claim 3, wherein (a) each end of said strap has attached slotted end pieces which can receive a button, (b) each side of the lower portion of said musical instrument having affixed button-shaped stud, (c) said slotted end-pieces being removably attached to said button-shaped studs, so that said strap may support the weight of said musical instrument, (d) a cushioning pad being slidably affixed to an underside of said strap, (e) said pad being positioned along said strap immediately over said musician's shoulder, (f) a cord whose near end is affixed to said pad, (g) said cord's distaff end being removably attached to the upper portion of said musical instrument in the general area at or above said musician's shoulder, (h) said cord having means of length adjustment so that said cord can be made taut between said pad and said attachment to upper portion of musical instrument, whereby said musical instrument can be supported upon the body of said musician and positioned in an upright, near-vertical position, thus facilitating certain types of musical play, including two-handed tapping or touch-style play.

5. A method of attaching and dynamically self-positioning a cushioning and weight-distributing pad to a strap assembly used for supporting a musical instrument or other tool or implement, such that the upper portion of said musical instrument is positioned in the region generally at or above a musician's shoulder, comprising:

(a) providing a strap assembly containing at least one strap segment which passes over said musician's shoulder, (b) providing, upon the lower region of said strap assembly, means of attachment to a lower portion of said musical instrument, (c) providing a pad of cushioning material with slidable means for attaching said pad to an underside of said strap segment and locating said pad above said musician's shoulder, (d) providing a cord affixed to said pad, said cord extending to and having means for attachment to an upper portion of said musical instrument, so that said upper portion of said musical instrument can be positioned in the general area of said musician's shoulder, whereby said musical instrument's weight is supported and cushioned upon said musician's shoulder by said pad, and said pad is prevented from sliding forward or backward off said musician's shoulder by upwardly-pulling tension afforded by said affixed cord's attachment to said musical instrument's upper portion, and whereby said pad continuously maintains its cushioning and weight-distribution function.

* * * * *